United States Patent [19]

Brennan

[11] 3,999,772

[45] Dec. 28, 1976

[54] ROLLER SKATE

[76] Inventor: William J. Brennan, 3135 Byrd, Dearborn, Mich. 48124

[22] Filed: July 24, 1975

[21] Appl. No.: 598,670

[52] U.S. Cl. ..... 280/11.23

[51] Int. Cl.[2] ..... A63C 17/06

[58] Field of Search ..... 280/11.23, 11.22, 11.19, 280/7.13, 11.3

[56] References Cited

UNITED STATES PATENTS

| | | | |
|---|---|---|---|
| 593,278 | 11/1897 | Moulton | 280/11.23 |
| 1,694,374 | 12/1928 | Colwell | 280/11.22 |
| 1,983,869 | 12/1934 | Nichol | 280/11.23 |
| 2,190,316 | 2/1940 | Harris | 280/7.13 |
| 2,377,366 | 6/1945 | Paystrup | 280/11.23 |
| 3,387,852 | 6/1968 | De Sarro | 280/11.22 |
| 3,901,520 | 8/1975 | McMahan | 280/11.23 |

FOREIGN PATENTS OR APPLICATIONS

| | | | |
|---|---|---|---|
| 944,183 | 3/1949 | France | 280/7.13 |
| 229,050 | 11/1910 | Germany | 280/7.13 |

*Primary Examiner*—Robert R. Song
*Assistant Examiner*—David M. Mitchell
*Attorney, Agent, or Firm*—Gifford, Chandler, Sheridan & Sprinkle

[57] ABSTRACT

A roller skate of the shoe-attached two wheel type includes for each skate a pair of U-shaped wheel support members appropriately spaced for the size shoes it is to be used with by a pair of side support members and attachable to a heel plate and a toe plate respectively which are attached to the shoe.

1 Claim, 2 Drawing Figures

ROLLER SKATE

BACKGROUND OF THE INVENTION

1. Field of the Invention

The present invention relates to roller skates and more particularly to a new construction for roller skates of the shoe attached two wheel type.

2. Description of the Prior Art

Shoe attached two wheel roller skates of course are not new. Conventional, four wheel, sidewalk skates are heavy and inefficient. Two wheel roller skates reduce friction on the skating surface and enables the skater to take a longer stride, thus covering more distance for the effort expended. Such skates provide the feeling of ice skates and thus permit a game simulating ice hockey to be played in the summer months in areas where ice is not available in those months.

Heretofore a serious problem with such skates has been the lack of rigidity between the spaced wheels. To function properly it is essential that the wheels of the skate be maintained in alignment during use. Because there are only two wheels on each skate sidewise stresses are particularly severe during use and require that strong side supports be provided between the wheels.

The solution to this problem has heretofore taken many forms but generally has resulted in a construction in which the wheel assembly is a unitary structure and can be used only with one size shoe. This substantially increases the cost of manufacturing shoe skates of this type in many different sizes.

SUMMARY OF THE PRESENT INVENTION

The present invention provides a roller skate of the shoe attached two wheel type in which the wheel assemblies include inverted U-shaped support members. Each wheel assembly is attached to the shoe of the skate and the assemblies are rigidly supported by a pair of side support members removably mounted to the sides of the wheel assemblies. A toe plate and a heel plate are provided intermediate the shoe and the front wheel assembly and the rear wheel assembly respectively.

Thus to accommodate different size shoes all that is necessary is that different length side members be provided. The same wheel assemblies can be used for any size shoe and the same heel and toe. Plates can be used for a wide range of sizes. This construction then substantially reduces the cost of providing different size shoe skates of the shoe attached two wheel type without sacrificing the required stability and support for the wheel assemblies.

DESCRIPTION OF THE DRAWINGS

A better understanding of the present invention will be achieved upon reference to the following description which refers to the enclosed drawing in which like reference numerals refer to like parts throughout the several views and in which.

DESCRIPTION OF A PREFERRED EMBODIMENT

Figure 1:
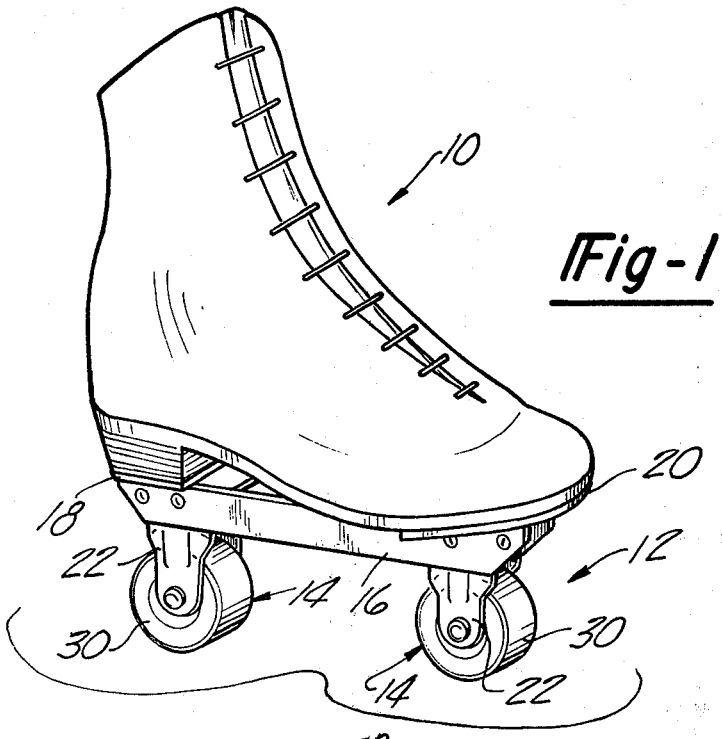
FIG. 1 is an elevational view of a roller skate of the present invention.

Now referring to the drawings a roller skate of the present invention is illustrated in FIG. 1 as including a shoe 10 and a roller assembly 12.

Figure 2:
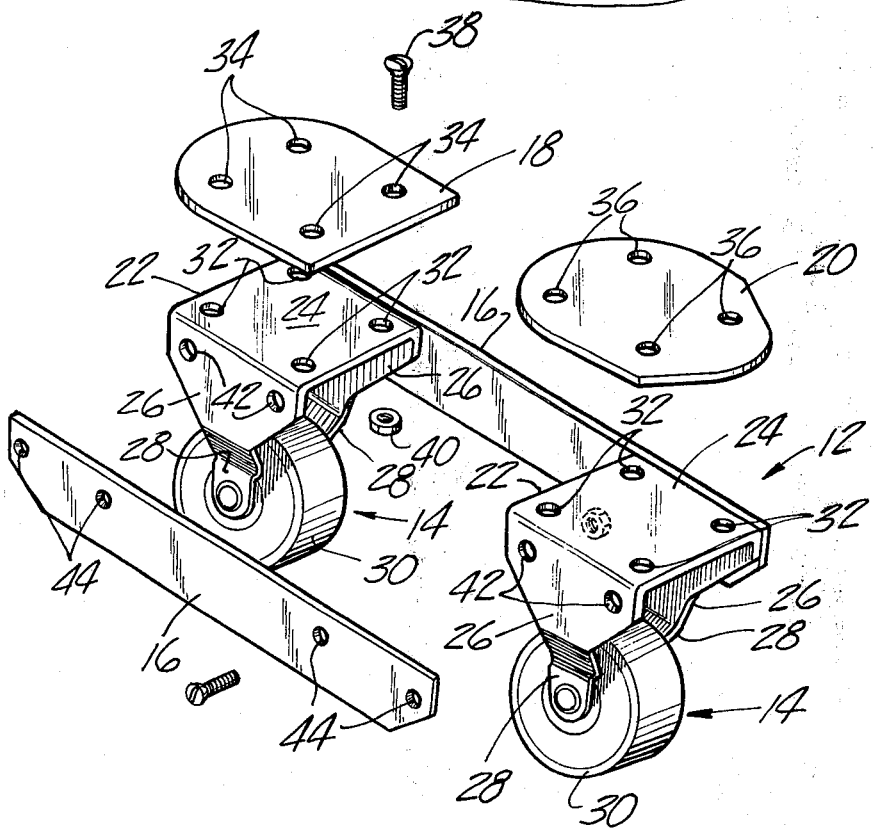
FIG. 2 is an exploded view of a portion of the structure shown in FIG. 1.

The roller assembly 12, as can best be seen in FIG. 2, preferably comprises a pair of wheel assemblies 14, a pair of side plates 16, a heel plate 18 and a toe plate 20.

Each wheel assembly 14 includes an inverted U-shaped support member 22 having a flat top portion 24 and downwardly extending legs 26. The legs 26 preferably are formed inwardly at their lower portions 28 and provide the means for rotatably supporting the wheels 30.

As can best be seen in FIG. 2, the top portion 24 of the support members 22 are provided with spaced apertures 32 and the heel plate 18 and toe plate 20 are provided with apertures 34 and 36 respectively which register with the apertures 32 to receive bolts 38 or similar fasteners to cooperate with nuts 40 to fasten the wheel assemblies 14, the heel plate 18 and the toe plate 20 to the shoe 10.

The legs 26 of the support members 22 are also provided with apertures 42 which coincide with apertures 44 provided in the side plates 16 to receive bolts 46 or similar fastening means to cooperate with nuts 40 to thereby securely fasten the side plates 16 to the legs 26 and thus fasten the wheel assemblies 14 together in alignment.

It is apparent that a roller skate of the shoe attached two wheel type has been described which is sufficiently strong to withstand the stresses which it will undergo during use. The manner of attaching the wheel assemblies 14 to the shoe 10 and the provision of the side plates 16 insures that the wheels 30 will be maintained in alignment so that the feeling of skating on a single runner ice skate will be created.

Further, although but a single skate has been described it is apparent that two skates will be provided and that the roller assembly 12 for each of the pair of shoes 10 will be identical. While it is contemplated that the roller skates will be sold as a finished product including the shoes it would be possible to sell the roller assemblies 12 in pairs for attachment to any pair of shoes.

One of the major advantages of the construction of the present invention is the interchangeability of parts and the incumbant savings in manufacturing costs achieved thereby. Only one size of wheel assemblies 14 need be provided to fit all sizes of shoes. The same heel plate 18 and toe plate 20 will accommodate shoes through a wide range of sizes. All that is necessary then is to provide different length side plates 16 to accommodate different size shoes. This is in contrast to the usual construction wherein the roller assembly 12 is a unitary structure and thus each size skate requires a different size roller assembly.

While only a single embodiment of the present invention has been described, it is apparent that other changes can be without departing from the spirit of the invention or the scope of the appended claims.

I claim:

1. A roller skate of the shoe-attached, two wheel type comprising: a shoe; a roller assembly a heel plate and a toe plate for attaching said roller assembly to said shoe, said heel and toe plates being in a spaced apart relationship; said roller assembly comprising a pair of substantially identical wheel assemblies each having a single wheel; each of said wheel assemblies further comprising an inverted U-shaped member for rotatably supporting said wheel, each of said wheel assemblies being individually detachable from said shoe; each of said U-shaped support members including a pair of downwardly extending spaced leg portions, said wheels being rotatably mounted between said leg portions and means for securing said wheel assemblies together in a spaced apart relationship so that each wheel is in alignment with the other wheel, said last mentioned means consisting of a first side plate, first releasable fastening means for attaching said first side plate at at least two points to one lateral side of each wheel assembly, a second side plate, and second releasable fastening means for attaching said second side plate at at least two points to the other lateral side of each wheel assembly.

* * * * *

UNITED STATES PATENT AND TRADEMARK OFFICE

CERTIFICATE OF CORRECTION

PATENT NO. : 3,999,772

DATED : December 28, 1976

INVENTOR(S) : William J. Brennan

It is certified that error appears in the above-identified patent and that said Letters Patent are hereby corrected as shown below:

Col. 2, line 60, after "be" insert --made--.

Signed and Sealed this

Eighth Day of March 1977

[SEAL]

*Attest:*

RUTH C. MASON
*Attesting Officer*

C. MARSHALL DANN
*Commissioner of Patents and Trademarks*